US006574856B2

(12) United States Patent
Raccosta et al.

(10) Patent No.: US 6,574,856 B2
(45) Date of Patent: Jun. 10, 2003

(54) MACHINE FOR AUTOMATICALLY APPLYING SNAP FASTENERS ON A SUPPORT

(76) Inventors: Gaetano Raccosta, Via Petarca, 5, 23807 Merate (Lecco) (IT); Sandro Raccosta, Via Petarca, 7, 23807 Merate (Lecco) (IT)

( * ) Notice: Subject to any disclaimer, the term of this patent is extended or adjusted under 35 U.S.C. 154(b) by 0 days.

(21) Appl. No.: 09/863,746

(22) Filed: May 23, 2001

(65) Prior Publication Data

US 2002/0007545 A1 Jan. 24, 2002

(30) Foreign Application Priority Data

Feb. 12, 2001 (IT) ..... MI01A0281
May 25, 2001 (IT) ..... MI00A1162

(51) Int. Cl.[7] ..... B23P 21/00

(52) U.S. Cl. ..... 29/709; 29/715; 29/798; 29/243.5; 227/2

(58) Field of Search ..... 29/407.01, 407.08, 29/524.1, 525, 525.01, 708, 709, 712, 714, 715, 720, 798, 243.5, 243.53, 453, 809; 227/2, 30, 31

(56) References Cited

U.S. PATENT DOCUMENTS 3,693,832 A * 9/1972 Adolphi ..... 221/93
4,007,537 A * 2/1977 Silverbush et al. ..... 29/809
4,703,882 A * 11/1987 Herten ..... 227/30
4,741,466 A * 5/1988 Birkhofer ..... 227/4
5,463,807 A * 11/1995 Hochhausl ..... 29/809
5,487,215 A * 1/1996 Ladouceur ..... 29/707
5,488,767 A * 2/1996 Franovick ..... 29/798
5,774,364 A * 6/1998 Kamps ..... 364/468.24
5,781,989 A * 7/1998 Schmidt ..... 29/809
5,957,362 A * 9/1999 Samulowitz et al. ..... 227/2
5,964,393 A * 10/1999 Feldpausch et al. ..... 227/135
6,089,437 A * 7/2000 Blacket et al. ..... 227/136

FOREIGN PATENT DOCUMENTS

JP 404169828 B1 * 6/1992

* cited by examiner

*Primary Examiner*—Gregory Vidovich
*Assistant Examiner*—Jermie E. Cozart
(74) *Attorney, Agent, or Firm*—Hedman & Costigan, P.C.

(57) ABSTRACT

A machine for automatically applying snap fasteners on a support, such as a fabric, comprises a sensor for sensing the instantaneous value of the riveting pressure applied to the machine punch elements.

With respect to prior machines for automatically applying snap fasteners, the machine according to the invention provides the advantage that the snap fastener can be applied to a fabric with a proper riveting pressure, so as to prevent both excessive pressures, which could damage the fabric, and insufficient pressures, which could not provide a proper connection of the snap fastener on the support, from being generated.

3 Claims, 6 Drawing Sheets

MACHINE FOR AUTOMATICALLY APPLYING SNAP FASTENERS ON A SUPPORT

BACKGROUND OF THE INVENTION

The present invention relates to a novel machine and method for applying pressure or snap fasteners on a support, such as, for example, a fabric material.

The field of the invention is that of the machine designed for automatically applying snap fasteners, either made of a metal material or not, and other fittings in general such as rivets, eyelets and the like, on support materials such as fabric, leather, paperboard, plastics materials and the like.

In this type of machine it is very important that the two portions forming the snap fastener be mutually clamped by pressure, the so-called "riveting" pressure, which is necessary to hold the snap fastener on its support material, such as a fabric material, without damaging the support material because of an excessive effort.

Moreover, it is very important to prevent reduced pressures of efforts which could lock the snap fastener with an insufficient locking or clamping force.

On the other hand, the above mentioned operating pressure would be undesirably modified if, because of a changing of the support material thickness, a corresponding variation of the punch element displacements applying the snap fastener portions would not be carried out: in other words, a larger operating displacement or stroke for smaller thicknesses and vice versa.

In prior art machines, the above mentioned requirements was met by providing specifically designed systems, such as microswitches or measurement sensors, provided for detecting the displacement or stroke amount of a bottom punch element which, in such an application, would be provided to yield depending on the thickness of the support material to which the two portions of the snap fasteners must be connected.

Thus, conventional automatic machines for applying snap fasteners, provides to use a riveting pressure which is indirectly determined, i.e. set depending on the yielding of the punch element under the pressure applied thereby onto the supporting material.

The above mentioned systems, however, have the drawback that the disclosed displacement of the punch element would change, for example because of a wear of movable portions or the like, from a set displacement, then the riveting pressure would be consequently undesirably modified to values which would be unsuitable for properly applying the snap fastener on the supporting fabric.

Moreover, prior machines are suitable to detect only the maximum riveting pressure, and are not designed to also detect the minimum riveting pressure value.

Thus, even if it is assured that the two portions of the snap fastener are not pressed with an excessive force on the supporting fabric, on the other hand it is possible that the minimum value of the riveting pressure is not achieved, which minimum value would be indispensable for preventing the snap fastener portions from detaching from the supporting fabric or material.

SUMMARY OF THE INVENTION

Accordingly, the main object of the present invention is to provide a novel machine and method for automatically applying snap or pressure fasteners on a support material and which, differently from prior approaches, are specifically designed for applying the snap fasteners with a proper value of the riveting pressure, also in an even and time repeatable manner.

Another object of the present invention is to provide a delivery device for automatic machines applying snap fasteners and other metal fittings in general.

Actually, prior snap fastener applying machines conventionally comprise a snap fastener or fitting delivery device including:

- a vessel for holding therein the snap fasteners to be supplied;
- a feeding and supplying system for feeding and supplying said snap fasteners to a delivery guide means, including either a rotary bell, or a vibrating means, or a swinging arm mechanism;
- at least a delivery guide means, for sending the individual snap fasteners to a gripper supplying assembly;
- a gripper supplying assembly including a plurality of loading rods for loading the individual snap fasteners toward a gripper and punch region to apply said snap fasteners to a fabric and the like material.

These prior machines are affected by several different drawbacks.

At, first, a missing snap fastener in a gripper (for example a male portion of the snap fastener in a top gripper), will cause an application of only a counter-male portion, with a consequent damaging of the fabric material due both to a mechanical action deriving from the applied snap fastener portion and an operation of the operator which must remove from the fabric material said counter-male element already fixed on said fabric.

Further drawback is that missing snap fasteners at the end portion of the guide means, due either to an empty condition of the snap fastener feeding vessel or to possible malfunctions and/or lockings inside the guide means.

In this case, it would be very important to collect information about the missing said snap fasteners at the end portion of the guide means, and to collect any further information due to possible jammings.

In the case of an excessively filled vessel, a further drawback would occur, i.e. that of not sufficiently supplying the snap fasteners in their guide means.

Thus, yet another main object of the present invention is to provide a delivery device and related automatic machine for applying snap fasteners, allowing an operator to apply said snap fasteners with high quality operations, thereby protecting the end product from any damages due to not properly feeding the snap fasteners or due to an application of damaged snap fasteners during their delivery step.

The above mentioned objects, as well as yet other objects, are achieved respectively by the machine and method as described herein.

Preferred embodiments of the invention are disclosed in the dependent claims.

BRIEF DESCRIPTION OF THE DRAWINGS

The above mentioned objects, features and advantages of the invention will become more apparent hereinafter from the following detailed disclosure of a preferred embodiment of the machine according to the invention, which has been disclosed, by way of an exemplary but not limitative embodiment, in the figures of the accompanying drawings.

BRIEF DESCRIPTION OF THE DRAWINGS

Figure 1:
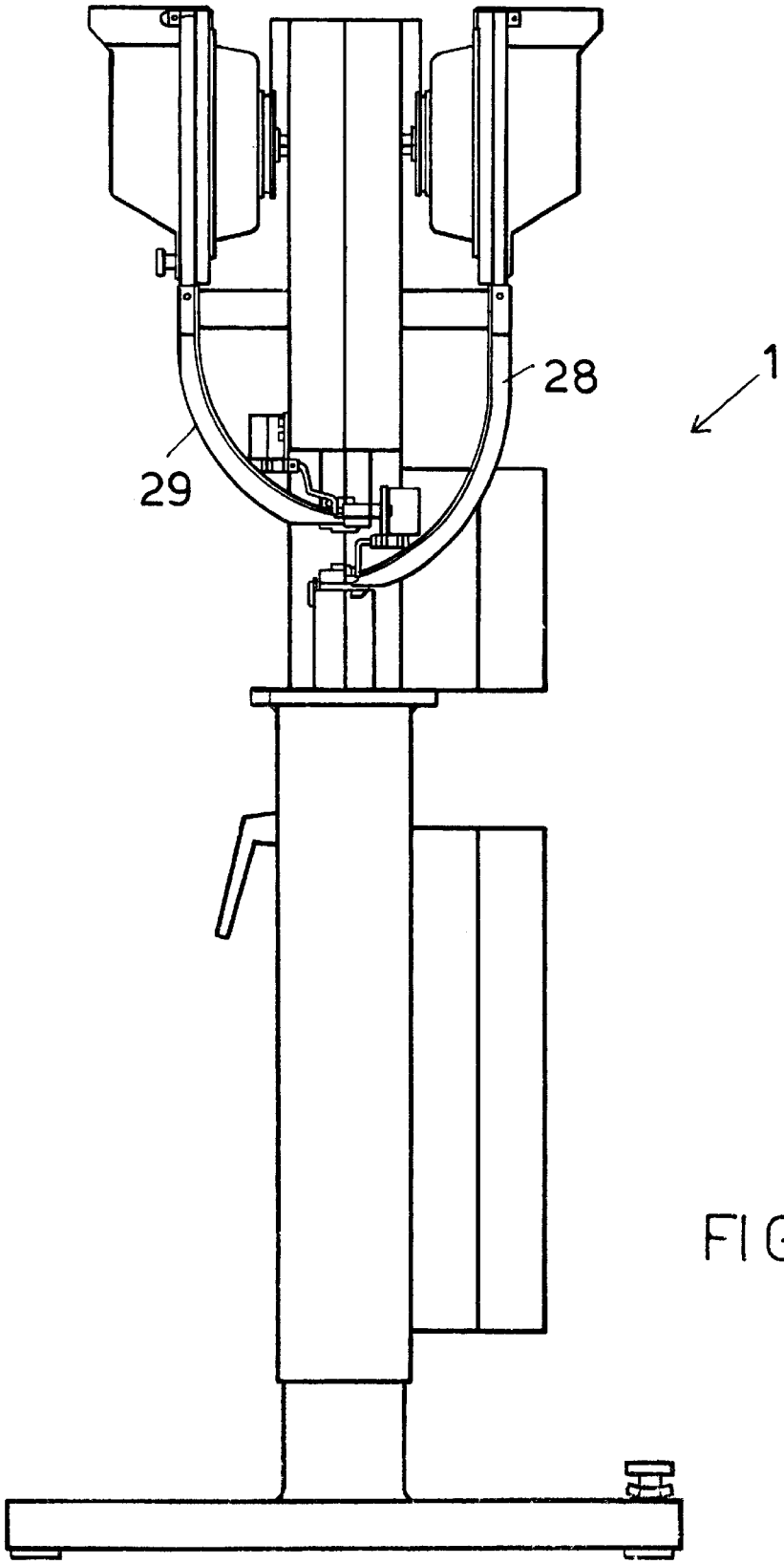
Figure 2:
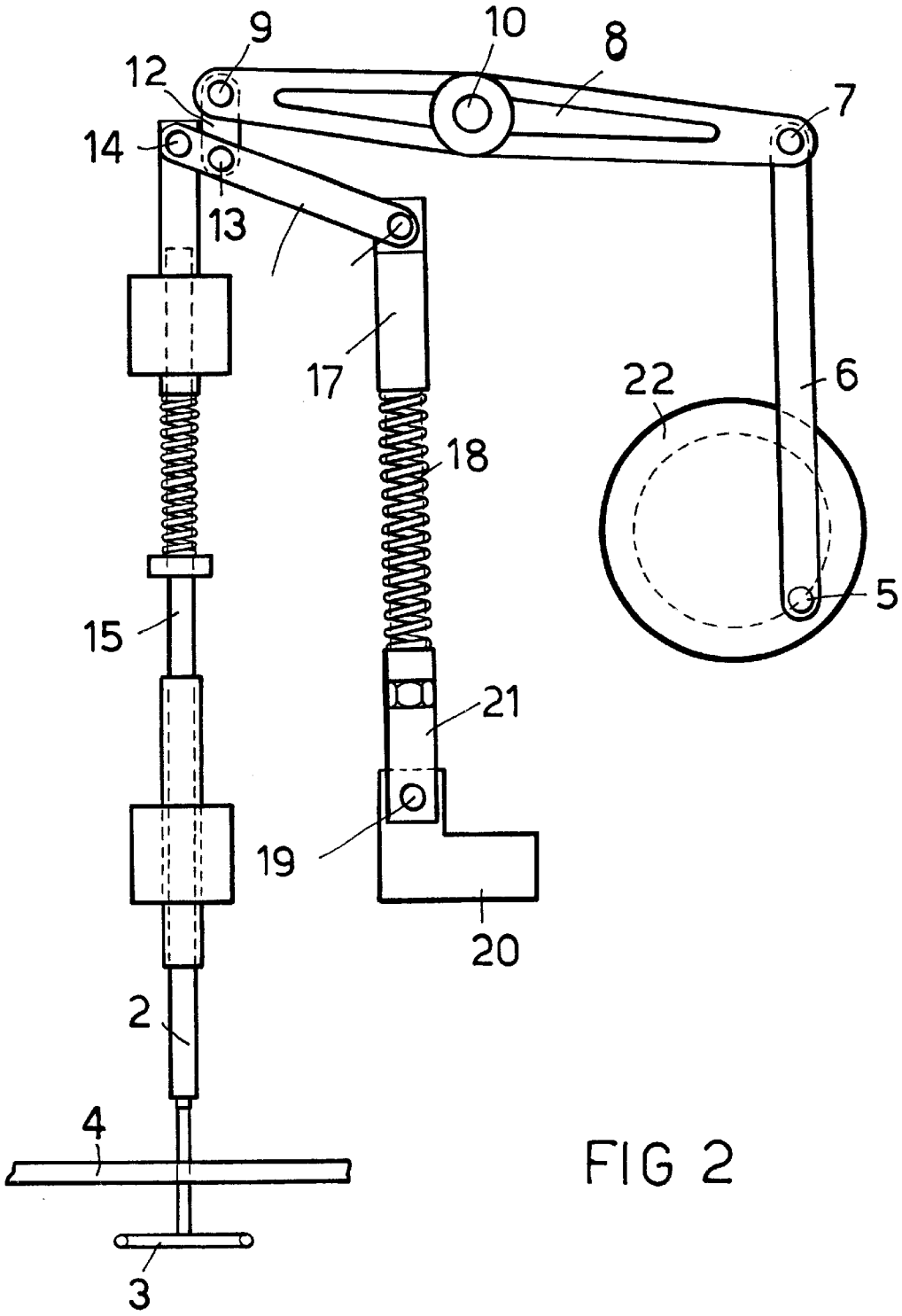
Figure 3:
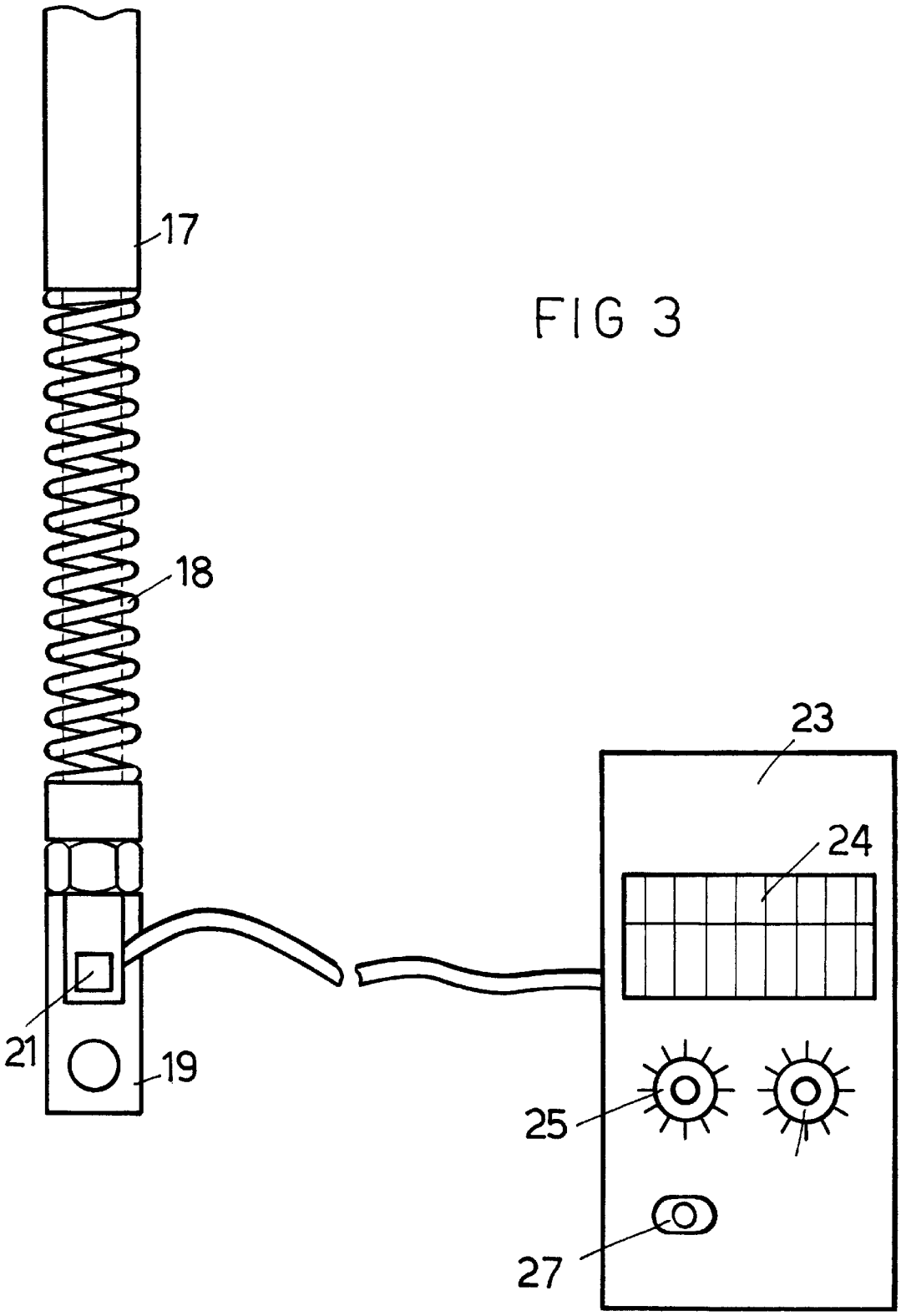
Figure 4:
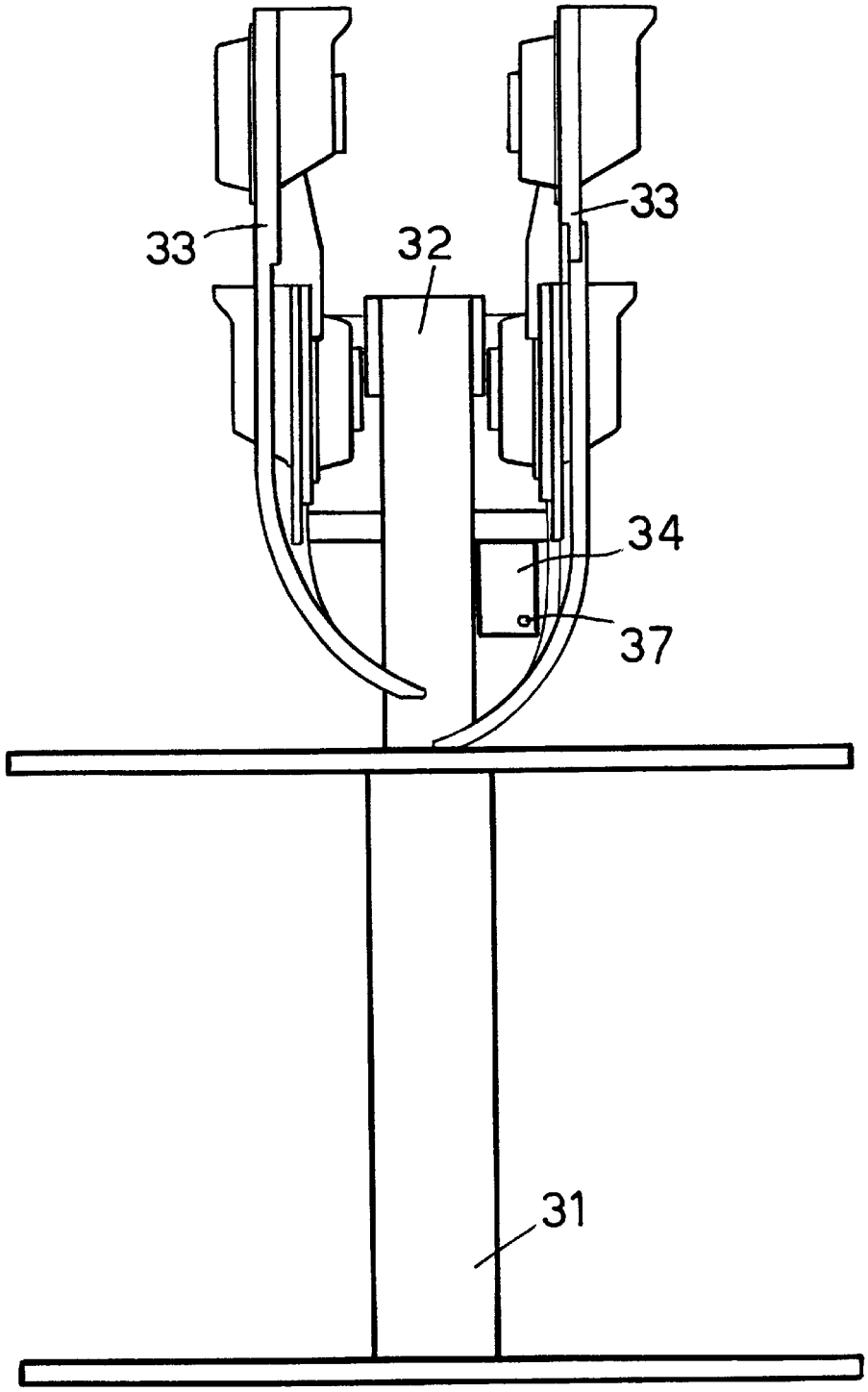
Figure 5:
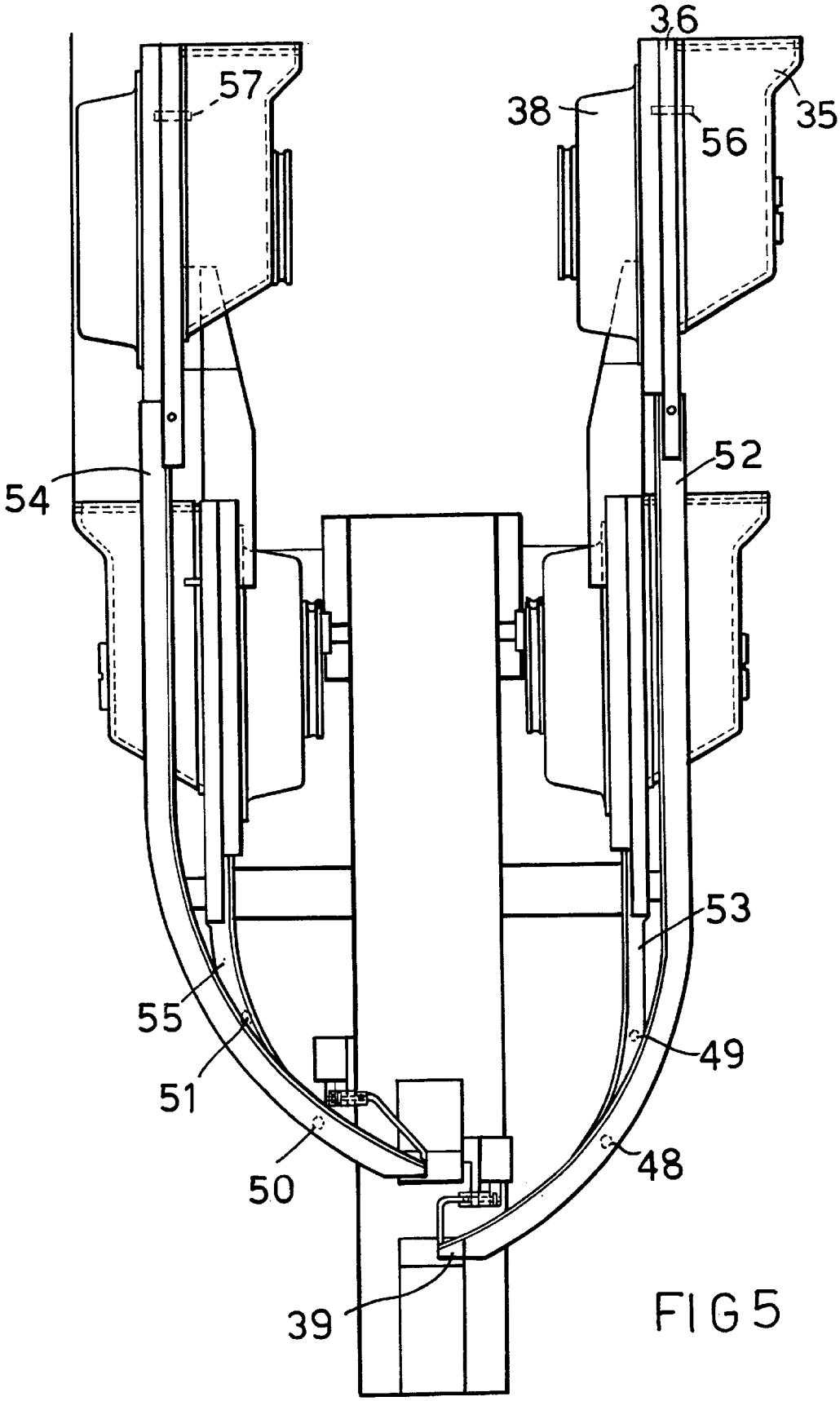

FIG. 1 is a general view illustrating the machine according to the present invention;

FIG. 2 illustrates the machine shown in FIG. 1, by a side view of the operating or driving mechanism thereof;

FIG. 3 illustrates a view of the pressure detecting device, applied on the machine shown in FIG. 2;

FIG. 4 is a front view illustrating a delivery device applied to an alternative embodiment of the machine according to the present invention;

FIG. 5 is a front view illustrating a view of the snap fastener supplying device applied to the machine of FIG. 4.

Figure 6:
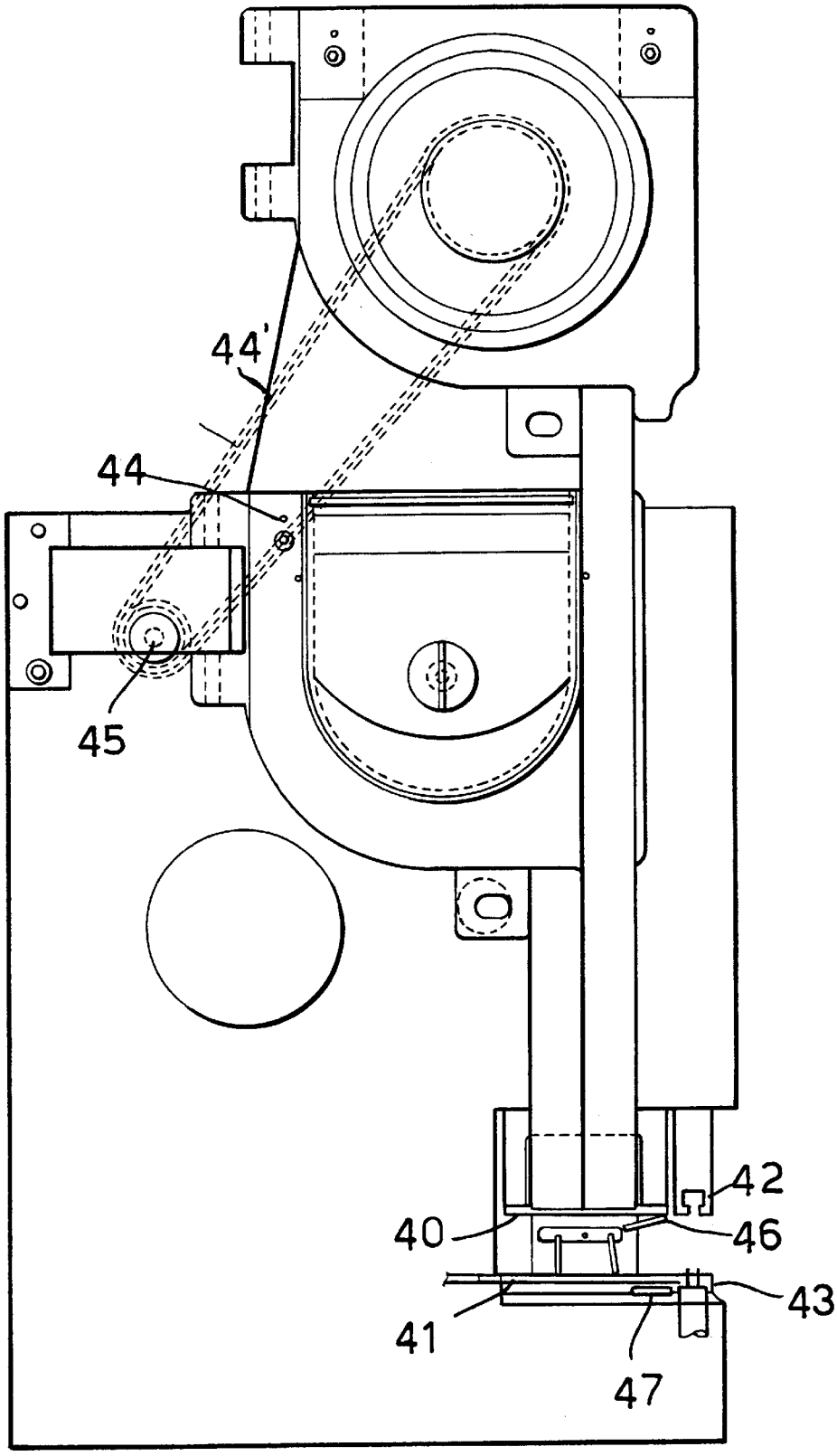

FIG. 6 is a side view illustrating the delivery device shown in FIG. 5.

DESCRIPTION OF THE PREFERRED EMBODIMENTS

With reference to FIGS. 1 and 2, the machine according to the present invention comprises a supplying and locating system 1 for respectively supplying and locating the snap fastener portions to punch elements, respectively a top punch element 2, and a bottom punch element 3, provided on respective faces of a support element 4 provided for receiving said snap fasteners, such as a support fabric.

As shown in FIG. 2, the top punch element 2 is driven starting from a crank pin 5 which, in turn, is driven by a suitable motor-reducing unit, not specifically shown.

To the crank pin 5 is coupled a rod 6, pivoted at an end portion 7 of a main lever 8.

The end portion 9 of said main lever 8, opposite to its fulcrum 10, or pivot pin, on the machine framework, is coupled to an inner point 13 of a secondary lever 11, through link elements 12.

The end portion 14 of the lever 11 transmits to the punch element, the driving from the lever 8, through the transmission shaft 15.

The remaining end portion 16 of the lever 11 is, in turn, coupled to a shaft 17, including a spring 18 and having its end portion 19 coupled to the framework 20 of the machine.

As shown in FIG. 2, the end portion 19 of the shaft 17 coupled to the framework 20 of the machine is provided with a sensor 21, for example a load cell, designed for sensing the riveting pressure value provided by said shaft 17 to the spring 18.

In addition to the riveting pressure sensing or detecting sensor 21, the machine according to the present invention can also comprise detecting device for detecting a presence of the snap fastener in a top gripper element (not shown), a presence of a snap fastener in a bottom gripper element (not shown), a passage of the snap fastener to a right guide 28, and a passage of the snap fastener to a left guide 29 (FIG. 1).

The operation cycle of the machine starts as the crank pin 5 is driven along its circular path 22, thereby causing the end portion 9 of the lever 8 to be lowered and, accordingly, a corresponding lowering of the top punch element 2 against the bottom punch element 3.

The pressure applied by the punch element 2 on the support 4 is instantaneously detected or sensed by the pressure sensor 21, through the assembly or system comprising the secondary lever 11, shaft 17, spring 18, and fixed framework 20.

In particular, an electronic center unit 23 coupled to the sensor 21 indicates, for example on a display 24, the value of the riveting pressure as detected or sensed by the sensor 21 (see FIG. 3).

The mentioned electronic center unit 23 is moreover calibrated or set on a maximum riveting pressure value and a minimum riveting pressure value and, outside the pressure range defined between the two mentioned pressure values, said electronic central unit will drive a stop of a following snap fastener applying cycle, while providing on the display 24 an indication of the riveting pressure value which has been achieved.

The center unit 23, in particular, controls the snap fastener application of riveting pressure as follows.

At the start of a new operating cycle for making a new cloth article or an article different from a preceding article, the operator carries out test applications, up to find a proper riveting or application pressure.

Then, by operating the pressure adjuster 25, the operator will set this pressure value, thereby the bar display 24 will be switched on to indicate the starting or "0" value (for example at about a half of the display).

Then, an alarm and stop adjuster 26 is set, to cause the machine to be automatically stopped as the snap fastener application pressure, as sensed by the sensor 21, is either excessively high or excessively low, with respect to the programmed or set value, i.e. as said pressure exits the maximum and minimum pressure values as preliminarily set.

The reset pushbutton 27 will be pressed for re-actuating the operation of the machine after a stop thereof due to a detection of a riveting pressure different from that set on the mentioned electronic center unit.

In particular, the latter will be of a type suitable to detect and store, by the above-mentioned devices, possible stop conditions of the machine, in the time and/or with respect to a preset number of operating cycles, due to missing snap fasteners in the grippers, missing snap fasteners in the guide means, or due to an erroneous value of the riveting pressure (either in excess or less than a preset riveting pressure). riveting pressure (either in excess or less than a preset riveting pressure).

The failure data would be made available for a production cycle analysis.

Owing to the above disclosed detection system, it is assured that the two portions of the snap fasteners are fixed on the support fabric 4 with the proper riveting pressure, depending on the thickness of said supporting fabric.

Moreover, any operations without a presence of a full snap fastener, or of one of the two portions thereof, are prevented.

Moreover, possible obstacles, susceptible to be present on the displacement path of the top punch element 2, are prevented from jamming or locking the proper operation of the machine.

The invention as disclosed and illustrated is susceptible to several modifications and variations, all of which will come within the scope of the accompanying claims.

Thus, for example, the sensor device used on the subject machine could be arranged at a different location.

In particular, said sensor can be also mounted, for example, at the bottom punch element 3 of the machine.

FIG. 4 illustrates a four way machine, for automatically applying fittings (for example snap or pressure fasteners) on articles in general (such as fabric, leather, plastic, paperboard materials and so on).

This machine essentially comprises a machine base 31 thereon is mounted a machine body 32 including applying means for applying said fittings, as well as a supplying device 33 for supplying the fittings or snap fasteners.

The machine also comprises a control central unit 34 which is also designed for collecting data.

As clearly shown in FIGS. 5 and 6, the device 33 comprises a tank or vessel 35 for holding said fittings or snap fasteners, said vessel being coupled to a plate 36 provided at the top portion of the guides 52, 53, 54 and 55 for delivering said fittings.

On that same plate 36 is moreover assembled a rotary bell feeder 38 for feeding said fittings, which communicates with the vessel 35 through a communicating opening (not shown).

The feeder 38 operates to properly direct the fittings so that they could be supplied inside the mentioned guides, which, in turn, are provided with slotted profiles, thereinto the fittings are caused to fall under the effect of gravity.

As better shown in FIGS. 5 and 6, at the end portion 39 of each said guide, the fittings are taken up by pusher elements 40 and 41, provided for individually feeding said fittings or snap fasteners, into the respective top 42 and bottom 43 grippers.

Moreover, as clearly shown in FIGS. 5 and 6, the rotary bell device 44 is driven through a belt 44', in turn driven by a pinion 45.

A first pair of sensors 46 and 47, designed for detecting the presence/absence of the snap fasteners in the grippers 42 and 43 are provided near said grippers.

Preferably, said sensors are of an optic fiber type and are coupled to the above mentioned control central unit 34.

In the case of a missing fitting or snap fasteners, the sensors 46 and 47 will prevent the machine from operating, to alert the operator to manually feed the snap fasteners into the grippers not provided with said fasteners.

Thus, the product being processed is prevented from being damaged because of erroneous operations of the machine.

Further sensors 48, 49, 50 and 51 are applied at the respective end portions of the guides respectively indicated by 52, 53, 54 and 55.

The above sensors are coupled to said central unit 34 and operate to detect the passage or absence of the mentioned fittings or snap fasteners inside the mentioned guides.

If a snap fastener would be missing, then the sensor will prevent the machine from operating, alerting the operator to signal, through a dedicated control 37 provided on said central unit 34, if the malfunction is due to an empty vessel 35 or to a jamming of the snap fasteners inside the guides 52, 53, 54 and 55.

Owing to the provision of the system including the sensors 48, 49, 50 and 51 and the control 37 on the central unit 34, it is possible to record the failure rate of the machine, in each set time period and for each batch to be processed.

Moreover, the detection of the presence of fittings or snap fasteners inside the guides, performed by the sensors 48, 49, 50, and 51, in combination with an absence of snap fasteners in the grippers, as detected by the sensors 46 and 47, provides the operator with a proper signalling of a possible jamming in the snap fasteners supplying at the outlet of the mentioned guides.

Further sensors 56 and 57 are finally arranged at the top portion of the vessels 35 and are designed to switch off the operation of the machine, if it exceeded a preset level corresponding to a maximum amount of snap fasteners in said vessels.

This would be susceptible to damage said snap fasteners inside the rotary bells 38.

In such a case, the operator will be alerted to lower the level of the snap fasteners, to partially empty their vessels.

The above disclosed and illustrated machine, of a four way supply type, can also comprise a different number of operating ways (respectively three, two or a single way), without departing from the scope of the present invention.

What is claimed is:

1. A machine for automatically applying snap fasteners, of the type comprising a snap fastener supplying and laying system, for supplying said snap fasteners to punch elements for applying said snap fasteners on a support material, a sensor for sensing an instantaneous value of a riveting pressure applied by said punch elements on said snap fasteners, said sensor being mounted on a support element which, at a side, is coupled to a framework of said machine and at another side, is coupled to a framework of said machine and at another side, is coupled to a driving mechanism for driving a top punch element for applying said snap fasteners, wherein said support element comprises a shaft including a spring and said driving mechanism for driving said punch element comprises a lever having one end thereof pivoted on a punch element supporting shaft and having another end thereof pivoted on said support element shaft including said spring at a position opposite to a coupling position of said support element shaft including said spring to said framework of said machine.

2. A machine according to claim 1, wherein said mechanism for driving said top punch element comprises a main lever pivoted to said framework of said machine and operatively coupled, at a side, to a rod driven by a motor reducing assembly, for operating, at another side thereof, said lever, through a link element coupling said main lever to a fulcrum point.

3. A machine according to claim 2, wherein a crank pin is coupled to said rod and movable along a circular path, said rod being coupled, at a position opposite to said crank pin, to one end of said main lever.

* * * * *